US006892811B2

(12) United States Patent
LaClare et al.

(10) Patent No.: US 6,892,811 B2
(45) Date of Patent: May 17, 2005

(54) TUBING STRING ANCHORING TOOL

(76) Inventors: G. Maurice LaClare, Box 245, Edam, Saskatchewan (CA), S0M 0V0; Michael Kobes, Box 34, Edam, Saskatchewan (CA), S0M 0V0

( * ) Notice: Subject to any disclaimer, the term of this patent is extended or adjusted under 35 U.S.C. 154(b) by 65 days.

(21) Appl. No.: 10/319,644

(22) Filed: Dec. 16, 2002

(65) Prior Publication Data

US 2004/0112590 A1 Jun. 17, 2004

(51) Int. Cl.[7] ..... E21B 23/04
(52) U.S. Cl. ..... 166/217
(58) Field of Search ..... 166/216, 217, 166/243, 208, 382

(56) References Cited

U.S. PATENT DOCUMENTS 3,283,405 A * 11/1966 Braswell ..... 30/103
5,623,991 A 4/1997 Jani
5,636,690 A * 6/1997 Garay ..... 166/216
6,041,859 A 3/2000 Blades
6,073,693 A * 6/2000 Aldridge ..... 166/217
6,318,459 B1 * 11/2001 Wright et al. ..... 166/117.6

* cited by examiner

*Primary Examiner*—Kenn Thompson
(74) *Attorney, Agent, or Firm*—Ryan W. Dupuis; Adrian O. Battison; Michael R. Williams

(57) ABSTRACT

An anchoring tool is provided for preventing rotation of a tubing string relative to a surrounding well casing in both right and left hand directions of rotation. The tool includes tubular housing for connection in line with the tubing string. A gripping member is supported alongside the housing for rotation about an anchor axis lying substantially parallel to the housing. The gripping member has a profile which increases in radial dimension from a first gripping portion to a second gripping portion thereof. The first gripping portion and the second gripping portion being arranged to grip the surrounding well casing in a retracted position and an extended position respectively. Rotation of the housing with the tubing string relative to the well casing rotates the gripping member in relation to the housing to vary an overall diameter of the anchoring tool within the well casing, thereby preventing further rotation. The gripping member is freely rotatable relative to the tubular housing in either direction of rotation from the retracted position to the extended position for anchoring in both directions of rotation of the housing.

19 Claims, 4 Drawing Sheets

TUBING STRING ANCHORING TOOL

FIELD OF THE INVENTION

This invention relates to an anchoring tool for anchoring a tubing string to a surrounding well casing.

BACKGROUND

Tubing strings are commonly used in oil production and generally comprise a plurality of threaded sections coupled together with an inline pump. Under certain conditions the pump can transmit large rotational forces to the tubing string which tends to release the threaded sections of the string. As this is undesirable anchors are commonly employed for preventing rotation of the tubing string in a direction corresponding to rotation of the rotor of the pump. In other situations however it may be desirable to manipulate the tubing string by preventing rotation of the tubing string In an opposite direction to the rotation of the pump. Anchoring of the tubing string may thus be desirable in both directions when it is desirable to set or unset various components coupled inline with the tubing string.

U.S. Pat. No. 5,523,991 to Jani provides a tubing tightener which is adaptable to anchor a tubing string against either clockwise or anti-clockwise rotation. The tubing tightener however requires a complex arrangement of drag slips which are operable for anchoring the tubing string in one direction only for any particular configuration of the slips. In use, the tubing tightener is thus only arranged for anchoring the tubing string in a single predetermined direction for which the tightener is configured.

U.S. Pat. No. 6,041,859 to Blades provides an anti-rotation device in which a gripping member is pivotally mounted on a housing of the device and includes a gripping surface which is arranged to engage the surrounding well casing for anchoring in one direction of rotation only. A spring is provided to bias the gripping surface into engagement with the well casing at all times.

SUMMARY

According to one aspect of the present invention there is provided an anchoring tool for preventing rotation of a tubing string relative to a surrounding well casing, the anchoring tool comprising:

- a tubular housing for connection in line with the tubing string; and
- a gripping member supported on the housing for rotation about an anchor axis lying substantially parallel to a longitudinal direction of the housing;
- the gripping member having a profile which increases in radial dimension from a first gripping portion to a second gripping portion;
- the first gripping portion being arranged to grip the surrounding well casing in a retracted position of the gripping member and the second gripping portion being arranged to grip the surrounding well casing in an extended position;
- whereby rotation of the housing with the tubing string relative to the well casing rotates the gripping member in relation to the housing to vary an overall diameter of the anchoring tool within the well casing.

Arranging both the first and second portions of the gripping member to grip the well casing in the respective retracted and extended positions of the gripping member enables the gripping member to rotate relative to the housing as the housing is rotated in either clockwise or anti-clockwise rotation in relation to the well casing to anchor the tool within the well casing in either direction of rotation.

The gripping member is preferably freely rotatable relative to the tubular housing in either direction of rotation from the retracted position to the extended position.

The second gripping portion may include a pair of sides extending from opposing sides of first gripping portion, each side of the second gripping portion having a radial dimension which is greater than that of the first gripping portion and being arranged to grip the well casing in a respective extended position.

When there is provided mounting means supporting the gripping member on the housing, the first portion of the gripping member is preferably arranged to extend radially outward past the mounting means in the retracted position.

The gripping member may be circular in cross section, being mounted for eccentric rotation about the anchor axis. Any shape or cam profile having increasing radial dimension would be suitable.

The gripping member is preferably an elongate member arranged to be supported alongside the housing, externally from the housing. The gripping member may extend a majority of a length of the housing for optimum grip with the well casing.

The gripping member is preferably supported at longitudinally spaced positions on the housing. When the gripping member is supported at respective ends thereof on the housing, there is preferably provided at least one intermediate support between respective ends of the housing.

Said at least one intermediate support preferably extends between the housing and the gripping member and includes an engaging face which is curved about the anchor axis at a free end thereof. The gripping member in this instance would preferably have a support section arranged to ride against the engaging face of said at least one intermediate support which is circular in cross section and concentric about the anchor axis.

The first and second gripping portions of the gripping member may include teeth formed of wear resistant material embedded in an outer surface of the gripping member so as to project outwardly from the outer surface.

The teeth may project outwardly from the outer surface of the gripping member, each offset at an incline from a respective radial axis of the gripping member into a direction of increasing radial dimension of the gripping surface from the first gripping portion to the second gripping portion.

When the gripping member is freely rotatable in both directions from the retracted position to the extended position, the teeth on opposing sides of the gripping member between the first gripping portion and the second gripping portion are preferably offset in opposing directions from their respective radial axes.

There may be provided a shaft extending through the gripping member along the anchor axis, supporting the gripping member on the housing for rotation about the shaft.

For use in a restricting relative rotation in one direction only, a stop member may be mounted on the housing arranged to restrict rotation of the gripping member from the retracted position to the extended position in one direction only.

The tubular housing preferably includes respective threaded ends for threaded securement to the tubing string.

When there is provided mounting means supporting respective ends of the gripping member on the housing, the mounting means are preferably sloped outwardly in the longitudinal direction of the housing at an inward incline towards the housing.

Also when there is provided mounting means supporting the gripping member on the housing, the mounting means may be arranged to be secured to the housing with threaded fasteners so as to be selectively separable from the housing.

There may be provided a spacer member mounted on the housing to project radially outwardly from the housing diametrically opposite the gripping member.

BRIEF DESCRIPTION OF THE DRAWINGS

In the accompanying drawings, which illustrate exemplary embodiments of the present invention.

DETAILED DESCRIPTION

Figure 1:
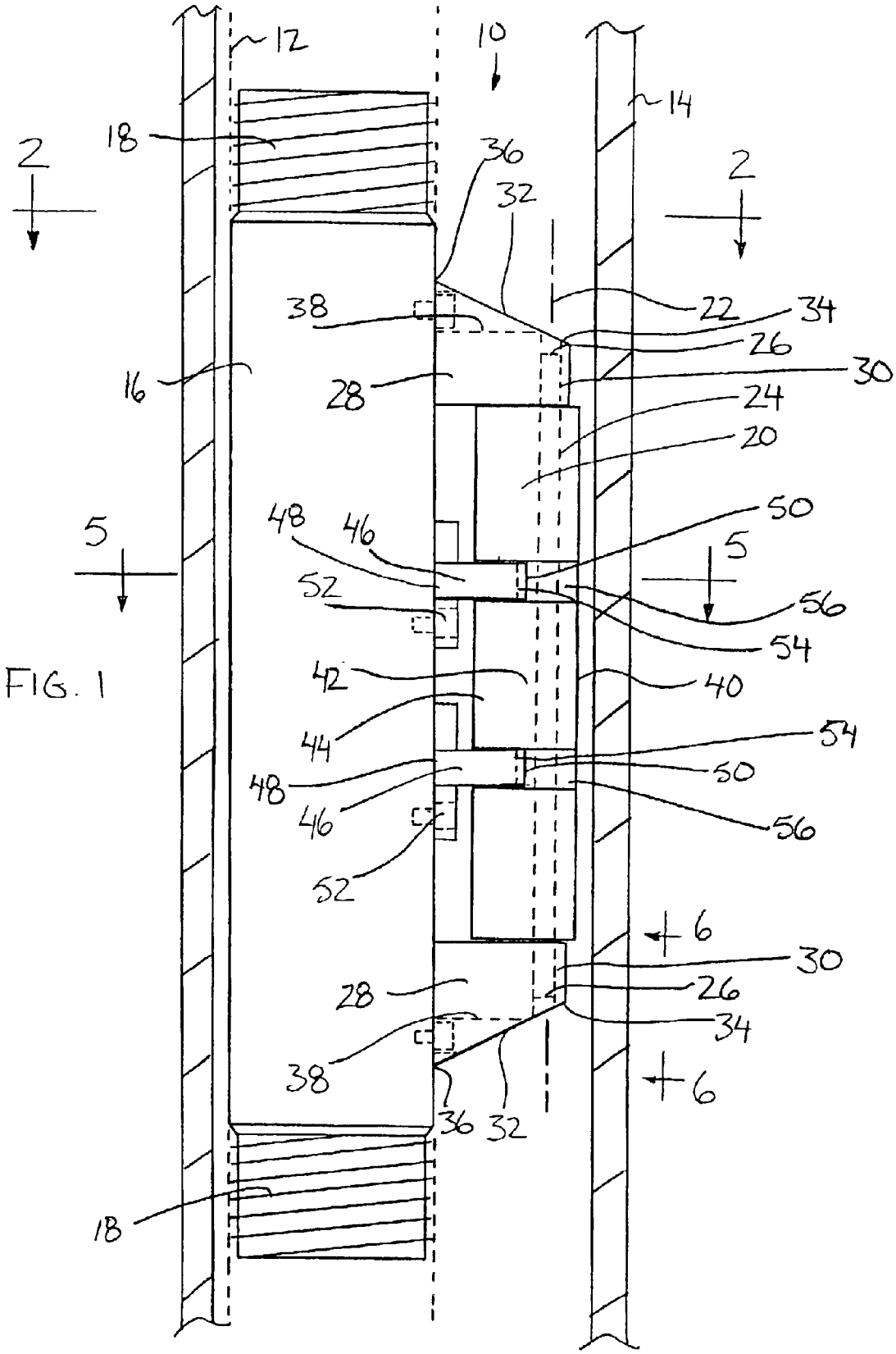
FIG. 1 is a side elevational view of the tool within a well casing.

Referring to the accompanying drawings there is illustrated an anchoring tool generally indicated by reference numeral 10. The tool is arranged for anchoring a tubing string 12 against rotation relative to a surrounding well casing 14 of the type commonly used in oil production. The anchoring tool 10 is arranged to anchor against relative rotation in either direction to resist rotation imposed by inline pumps of the tubing string or other rotations in other directions due to setting and unsetting operations of various components of the tubing string including down hole flow control valves and the like.

The tool 10 includes a tubular housing 16 which is elongate and hollow having externally threaded ends 18 for connection to the tubing string 12 in series therewith. The tubular housing 16 is arranged to have a similar inner diameter and outer diameter as the tubing string 12 for connection to the tubing string in alignment therewith.

A gripping member is provided in the form of an elongate roller 20 which is mounted alongside the housing externally from the housing spaced outwardly therefrom. The roller 20 is generally circular in cross section and extends substantially the length of the housing in the longitudinal direction of the housing. The roller 20 is supported on the housing for eccentric rotation about an anchor axis 22 extending in the longitudinal direction of the roller and lying generally parallel to the housing 16.

The roller 20 is supported for rotation on a shaft 24 extending through the roller 20 in the longitudinal direction thereof along the anchor axis 22. The shaft 24 is supported at respective ends 26 on the housing by shaft mounts 28. Each shaft mount 28 projects radially outwardly from the housing at a respective end of the shaft 24 for receiving the end 26 of the shaft within a respective bore 30 rotatably supporting the shaft therein.

An outer side 32 of each shaft mount 28, which faces outwardly from the roller 20 in the longitudinal direction of the housing, is sloped from an outer end 34 supporting the end of the shaft therein to an inner end 36 adjacent the housing. The outer side 32 extends from the outer end 34 to the inner end 36 outward from the end of the roller 20 in the longitudinal direction of the housing at an incline radially inwardly towards the housing. The sloped outer side 32 prevents the shaft mounts from catching on seams in the well casing 14 when the tool 10 is inserted into or removed from the well.

A fastener bore 38 extends through each shaft mount in a radial direction of the housing 16 adjacent the inner end 36 of the outer side of the respective mount. The fastener bore 38 of each shaft mount 28 is arranged to receive a respective threaded fastener therethrough for bolting the shaft mount 28 onto the outer surface of the housing 16. The roller 20 and shaft mounts 28 which support it on the housing 16 are thus arranged to be selectively separable from the housing by removing the fasteners from the fastener bores 38. The roller 20 is thus suitably arranged for attachment to a tubing section of an existing tubing string.

The roller 20 includes a first gripping portion 40 at an outer surface of the roller at a point where the roller has its shortest radial dimension from the anchor axis 22 to the outer surface of the roller. The roller 20 is arranged to increase in radial dimension from the first gripping portion 40 to a second gripping portion 44 opposite the first portion 40 at a point along an outer surface of the roller having the greatest radial dimension between the outer surface and the anchor axis 22 along both sides 42 of the roller. Both sides 42 between the first and second gripping portions are thus arranged to increase in radial dimension from the first gripping portion to the second portion.

Figure 2:
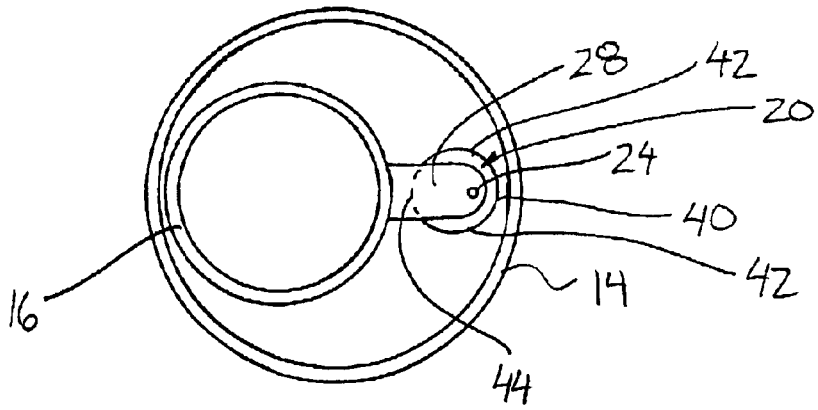
FIG. 2 is a sectional view along the line 2—2 of FIG. 1 in an unlocked position of the tool.
Figure 3:
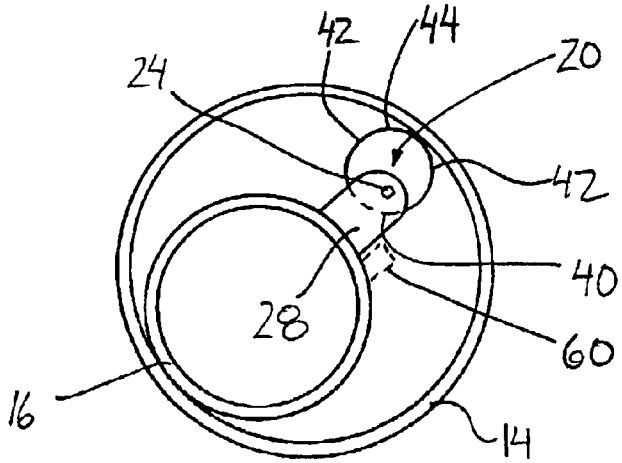
FIG. 3 is a sectional view along the line 2—2 of FIG. 1 in a lefthand locked position of the tool.
Figure 4:
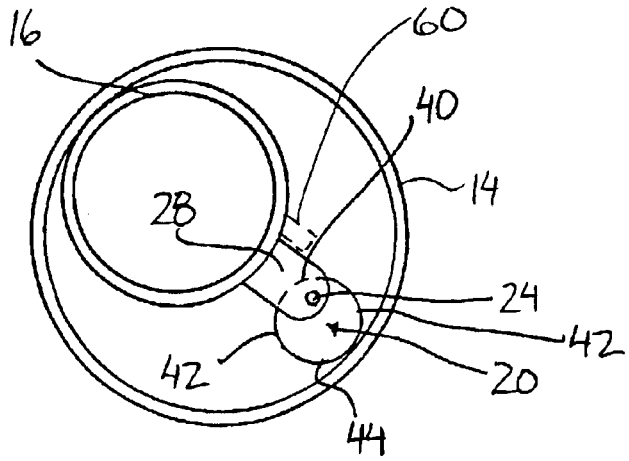
FIG. 4 is a sectional view along the line 2—2 of FIG. 1 in a righthand locked position of the tool.
Figure 5:
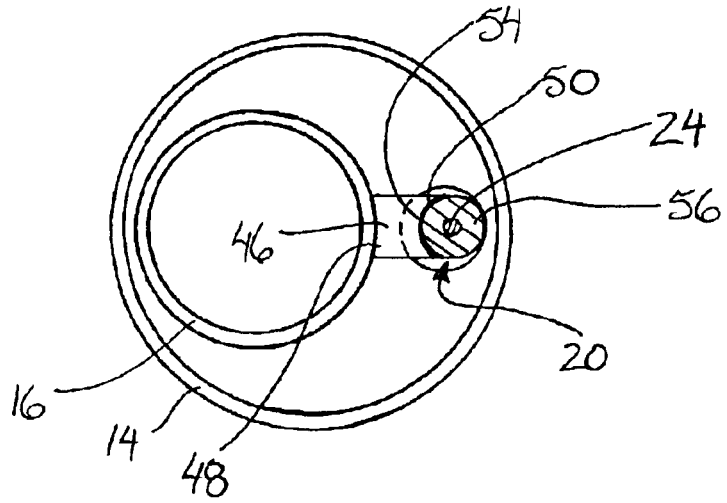
FIG. 5 is a sectional view along the line 5—5 of FIG. 1.
Figure 6:
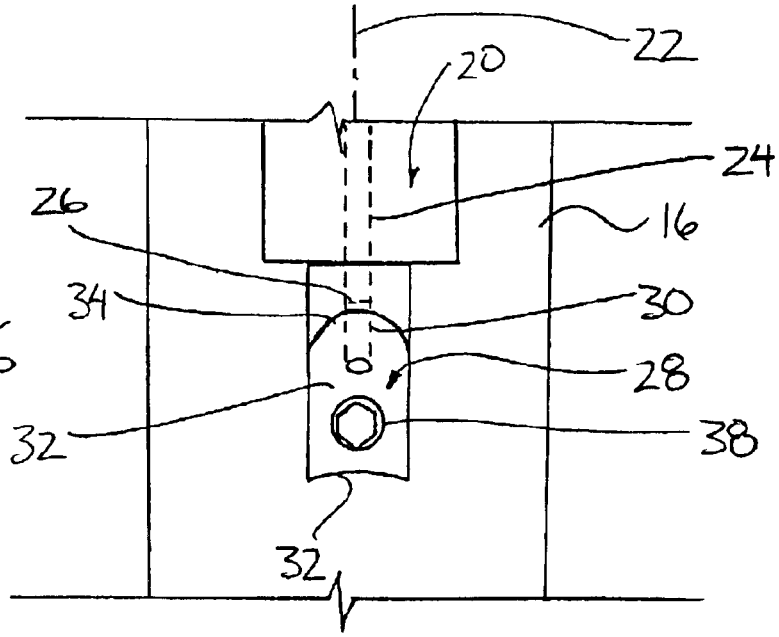
FIG. 6 is a side elevational view along the line 6—6 of FIG. 1.

The roller 20 is thus arranged to be rotated between a retracted position as shown in FIG. 2 and one of two extended positions shown in FIGS. 3 and 4. In the retracted position of the roller 20, the first gripping portion 40 faces radially outwardly from the housing so that the tool 10 has its smallest overall diameter. The first gripping portion 40 of the roller 20 is arranged to be spaced radially outwardly beyond the outer end 34 of the shaft mounts 28 so that the first gripping portion 40 is still arranged to grip the surrounding well casing 14 even in the retracted position of the roller.

In each extended position, a respective one of the sides 42 of the roller adjacent the second gripping portion 44 faces outwardly to increase an overall diameter of the tool 10 in relation to the retracted position. In the extended position the overall diameter of the tool is arranged to be approximately equal to an inner diameter of the well casing 14. Continued rotation past the extended position of the roller results in a fully extended position of the roller in which the second gripping portion 44 of the roller, diametrically opposite the first gripping portion 40, faces outwardly with the overall diameter of the tool being arranged to be greater than an inner diameter of the well casing. Urging continued rotation of the roller beyond the extended position towards the fully extended position thus frictionally engages the tool 10 within the well casing for setting the tool.

The roller 20 is arranged so that it is freely rotatable from the retracted position to either extended positions of FIGS. 3 and 4 in either respective direction of rotation. The roller 20 is positioned so that the outer surface of the roller always extends past the shaft mounts 28 so that the outer surface of the roller is always arranged to grip the well casing in either extended or retracted positions of the roller. The roller 20 is thus arranged to ride along the casing wall when the string is rotated to rotate the roller 20 between the respective retracted position in which the tool is unset to one of the extended positions in which the tool may be set.

The roller 20 is supported at two longitudinally spaced positions intermediate the respective ends thereof by a pair of intermediate supports 46. The intermediate supports 46 are evenly spaced between each other and the shaft mounts 28 at respective ends of the roller 20. Each intermediate support 46 is mounted at an inner end 48 on the housing to extend radially outwardly from the housing to a free end 50 which engages the roller 20 at a fixed spacing from the housing 16. The inner end 48 of each intermediate support 46 includes a flange portion 52 having a bore therein arranged to receive a threaded fastener for bolting the intermediate supports 46 to the housing similarly to the shaft mounts 28 so as to be selectively separable from the housing.

The free end 50 of each intermediate support 46 includes a bearing surface 54 which is curved about the anchor axis 22. The roller 20 includes a support section 56 formed integrally in the housing in alignment with each intermediate support 46. At the support section 56 the cross section of the roller 20 changes so as to have a circular cross section which is reduced in diameter and offset from the remainder of the roller in a manner so as to be concentric with the anchor axis 22. An outer surface of the support section 56 thus has a consistent radial spacing from the anchor axis 22 and from the housing 16 as the roller 20 is rotated. The support section 56 and the bearing surface 54 are both smooth in texture with the support section 56 being arranged to ride against the bearing surface 54 during the complete revolution of the roller 20.

In further embodiments, the roller may be supported only at respective ends thereof such that intermediate supports 46 are not required.

The outer surface of the roller 20 includes teeth 58 therein for gripping the well casing 14. Each tooth 58 is formed of a wear-resistant carbide material which is mounted within the outer surface of the roller 20. Each tooth is generally cylindrical having flat ends forming an annular cutting edge about each end thereof with the tooth being embedded only part way into the outer surface of the roller so that one end of the cylinder including the annular edge thereof projects outwardly from the surface to grip the well casing.

Each of the teeth 58 projects outwardly from the outer surface of the roller 20 offset from a respective radial axis extending from the anchor axis 22 in a direction of increasing radial dimension of the roller from the first gripping portion 40 to the second gripping portion 44. The teeth 58 on the opposing sides 42 of the roller 20 are thus oriented in opposite directions in a manner so that the teeth on both sides are offset into the direction of increasing radial dimension from the first gripping portion to the second gripping portion along the respective side 42.

The teeth may optionally be replaced with any other suitable gripping configuration including shaping the outer surface of the roller 20 with grooves or integral teeth or providing various shaped gripping members embedded or fastened by various means to the roller. Fastening of gripping members may include brazing or welding as well as the use of fasteners.

As shown in dotted line in FIGS. 3 and 4, a stop member 60 may be mounted on the housing 16 to project radially outwardly from the housing spaced circumferentially from the shaft mounts 28. Only one stop member 60 is mounted on the housing for any given particular configuration so as to be arranged to restrict rotation of the roller 20 from the retracted position to the extended position in one direction of rotation only so that the tool can only be set in one direction.

As shown in FIG. 3 when viewed from above, mounting the stop member 60 to the right of the shaft mounts 28 at a longitudinal spacing in alignment with the roller 20 prevents the tool from being set when the tool is rotated in a righthand direction relative to the well casing but the roller 20 is still free to rotate into the extended position for setting the tool when the string is rotated in a lefthand direction.

The reverse occurs as shown from above in FIG. 4 when a stop member 60 is mounted to the left of the shaft mounts 28 in longitudinal alignment with the roller 20 in which rotation of the roller 20 into the extended position when the tool is rotated in a lefthand direction is prevented, while the roller 20 remains free to rotate into the extended position for setting the tool when the tool is rotated in a righthand direction. Configuring the tool to be set in one direction only, either righthand or lefthand rotation, may be desirable in certain applications of the tool.

Figure 8:
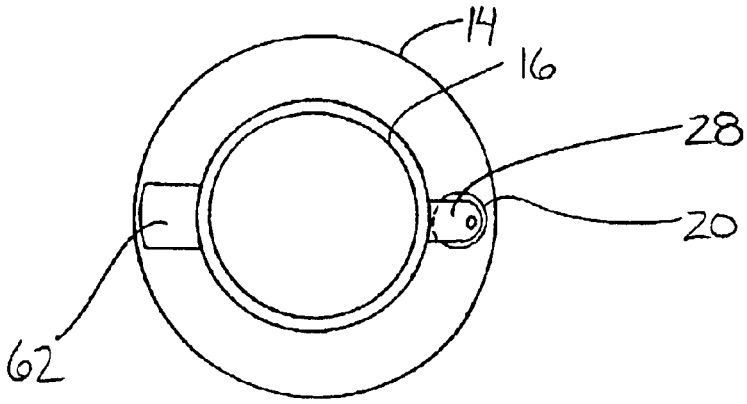
FIG. 8 is a sectional view from above of an alternate embodiment of the tool.
Figure 7:
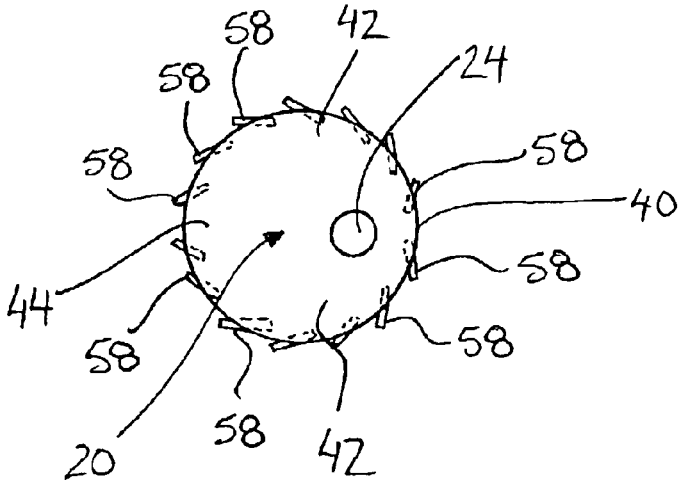
FIG. 7 is a top plan view of the gripping member illustrating the mounting of the teeth therein.

In an alternate embodiment as shown in FIG. 8, a spacer block 62 may be mounted on the housing 16 to extend radially outwardly from the housing diametrically opposite the roller 20 supported on the housing by shaft mounts as in the previous embodiment. The spacer block 62 would project radially from the housing a spacing which substantially equals an outer side of the roller in the extended position so that the housing 16 and the tubing string 12 connected thereto are generally centered within the well casing 14 when the tool is set. An outer side of the spacer block is configured for gripping the well casing. In place of the spacer block 62, a second roller 20 may also be provided diametrically opposite the first roller 20 for gripping opposing sides of the well casing.

Figure 9:
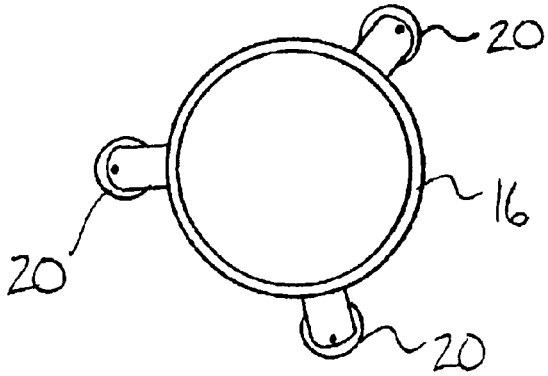
FIG. 9 is a further embodiment in which a plurality of gripping members are provided about the housing.

In a further embodiment as shown in FIG. 9, a plurality of rollers 20 may be mounted circumferentially spaced about a periphery of the housing 16 for gripping the well casing at plural locations about an inner surface of the well casing. In this arrangement the overall outer diameter of the tool with the gripping members in the respective retracted positions is preferably close in tolerance to the inner diameter of the well casing such that the rollers 20 engage the well casing for rotation into the retracted position at approximately the same time.

In any embodiment, the tool 10 is particularly useful when it is desirable to restrict relative rotation between the tubing string and the well casing in both clockwise (righthand) and anti-clockwise (lefthand) rotation as viewed from above. The tool 10 is mounted in line with the tubing string 12 similarly to a conventional tubing section of the tubing string by threadably securing the ends of the tool to the string. Once inserted into a well casing, the string is rotated from the unset position of FIG. 2 in the direction in which it is desired to prevent further rotation of the tubing string.

As the tubing string is rotated, the first gripping portion 40 of the roller 20 is arranged to grip the well casing so that the roller 20 rides along the inner wall of the casing with rotation of the string to increase the overall diameter of the tool as the roller 20 is displaced towards the extended position thereof. In the extended position as shown in either of FIGS. 3 and 4, the tool is set to prevent further rotation of the tubing string in the direction in which the tool was set. Reversing the rotation of the tubing string permits the roller 20 to again ride along the inner wall of the casing into the unset position of the tool in which the roller is in the retracted position and the overall diameter of the string is reduced. Continued rotation in the reverse direction will set the tool in the opposite direction to the first setting direction noted above. The use of a stop member 60 would prevent setting in the reverse direction.

While various embodiments of the present invention have been described in the foregoing, it is to be understood that other embodiments are possible within the scope of the invention. The invention is to be considered limited solely by the scope of the appended claims.

What is claimed is:

1. An anchoring tool for preventing rotation of a tubing string relative to a surrounding well casing, the anchoring tool comprising:

a tubular housing for connection in line with the tubing string; and a gripping member supported on the housing for rotation about an anchor axis lying substantially parallel to a longitudinal direction of the housing;

the gripping member having a profile which increases in radial dimension from a first gripping portion to a second gripping portion;

the first gripping portion being arranged to grip the surrounding well casing in a retracted position of the gripping member;

the gripping member being rotatable relative to the tubular housing from the retracted position in a first direction towards a first extended position and from the retracted position in a second direction towards a second extended position in which the second gripping portion is arranged to grip the surrounding well casing in both the first and the second extended positions;

whereby rotation of the housing with the tubing string relative to the well casing rotates the gripping member in relation to the housing to vary an overall diameter of the anchoring tool within the well casing.

2. The anchoring tool according to claim 1 wherein the second gripping portion includes a pair of side, extending from opposing sides at first gripping portion, each side of the second gripping portion having a radial dimension which is greater than that of the first gripping portion and being arranged to grip the well casing in a respective one of the extended positions.

3. The anchoring tool according to claim 1 wherein the gripping member is arranged to be supported alongside the housing, externally from the housing.

4. The anchoring tool according to claim 1 wherein there is provided mounting means supporting the gripping member on the housing, the first portion of the gripping member being arranged to extend radially outward pest the mounting means in the retracted position.

5. The anchoring tool according to claim 1 wherein there is provided a shaft extending through the gripping member along the anchor axis mud supporting the gripping member on the housing for rotation about the shaft.

6. The anchoring tool according to claim 1 wherein there is provided a stop member selectively mounted on the housing arranged to restrict rotation of the gripping member from the retracted position to the extended position in one direction only.

7. The anchoring tool according to claim 1 wherein the tubular housing includes respective threaded ends for threaded securement to the tubing string.

8. The anchoring tool according to claim 1 wherein there is provided mounting means supporting respective ends of the gripping member on the housing, the mounting means being eloped outwardly in the longitudinal direction of the housing at an inward incline towards the housing.

9. The anchoring tool according to claim 1 wherein there is provided mounting means supporting the gripping member on the housing, the mounting means being arranged to be secured to the housing with threaded fasteners so as to be selectively separable from the housing.

10. The anchoring tool according to claim 1 wherein there a provided a spacer member mounted on the housing to project radially outwardly from the housing diametrically opposite the gripping member.

11. An anchoring tool for preventing rotation of a tubing string relative to a surrounding well casing, the anchoring tool comprising:

a tubular housing for connection in line with the tubing string; and a gripping member supported on the housing for rotation about an anchor axis lying substantially parallel to a longitudinal direction of the housing;

the gripping member having a profile which increases in radial dimension from a first gripping portion to a second gripping portion;

the first gripping portion being arranged to grip the surrounding well casing in a retracted position of the gripping member and the second gripping portion being arranged to grip the surrounding well casing in an extended position;

whereby rotation of the housing with the tubing string relative to the well casing rotates the gripping member in relation to the housing to vary an overall diameter of the anchoring tool within the well casing;

wherein the gripping member is circular in cross section and the gripping member is mounted for eccentric rotation about the anchor axis.

12. The anchoring tool according to claim 11 wherein the gripping member is freely rotatable relative to the tubular housing in either direction of rotation from the retracted position to the extended position.

13. The anchoring tool according to claim 11 wherein the gripping member is an elongate member extending alongside the housing.

14. The anchoring toot according to claim 13 wherein the gripping member extends a majority of a length of the housing.

15. The anchoring tool according to claim 13 wherein the gripping member is supported at longitudinally spaced positions on the housing.

16. The anchoring tool according to claim 13 wherein the gripping member is supported at respective ends thereof on the housing and wherein there is provided at least one intermediate support between respective ends of the housing.

17. The anchoring tool according to claim 16 wherein said at least one intermediate support extends between the housing and the gripping member and includes an engaging face which is curved about the anchor axis at a free end thereof, the gripping member having a support section arranged to ride against the engaging face of said at least one Intermediate support, the support section of said at least one intermediate support being circular in cross section and concentric about the anchor axis.

18. An anchoring tool for preventing rotation of a tubular string relative to a surrounding well casing, the anchoring tool comprising:

a tubular housing for connection in line with the tubing string; and a gripping member supported on the housing for rotation about an anchor axis lying substantially parallel to a longitudinal direction of the housing;

the gripping member having a profile which increases in radial dimension from a first gripping portion to a second gripping portion;

the first gripping portion being arranged to grip the surrounding well casing in a retracted position of the gripping member and the second gripping portion being arranged to grip the surrounding well casing in an extended position;

whereby rotation of the housing with the tubing string relative to the well casing rotates the gripping member in relation to the housing to vary an overall diameter of the anchoring tool within the well casing;

wherein the first and second gripping portions of the gripping member include teeth formed of wear resistant material embedded in an outer surface of the gripping member so as to project outwardly from the outer surface; wherein the teeth project outwardly from the outer surface of the gripping member, each offset at an incline from a respective radial axis of the gripping member into a direction of increasing radial dimension of the gripping surface from the first gripping portion to the second gripping portion.

19. The anchoring tool according to claim 18 wherein the gripping member is freely rotatable in both directions from the retracted position to the extended position, the teeth on opposing sides of the gripping member between the first gripping portion and the second gripping portion being offset in opposing directions from their respective radial axes.

* * * * *